US006733343B2

(12) United States Patent
Morita et al.

(10) Patent No.: US 6,733,343 B2
(45) Date of Patent: May 11, 2004

(54) ANTI-MISMATCHING PAIR OF COMPLEMENTARY CONNECTORS

(75) Inventors: Makoto Morita, Nisshin (JP); Toshiaki Horii, Nisshin (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/190,730

(22) Filed: Jul. 9, 2002

(65) Prior Publication Data

US 2003/0017748 A1 Jan. 23, 2003

(30) Foreign Application Priority Data

Jul. 18, 2001 (JP) ..... 2001-217745

(51) Int. Cl.[7] ..... H01R 13/64
(52) U.S. Cl. ..... 439/680
(58) Field of Search ..... 439/680, 79, 681

(56) References Cited

U.S. PATENT DOCUMENTS 4,813,892 A * 3/1989 Strate ..... 439/681
5,137,467 A * 8/1992 Arai ..... 439/374
5,816,842 A * 10/1998 Thantrakul et al. ..... 439/374
6,010,368 A * 1/2000 Tai ..... 439/637
6,319,068 B1 * 11/2001 Bao ..... 439/680

* cited by examiner

*Primary Examiner*—Gary F. Paumen
(74) *Attorney, Agent, or Firm*—Antonelli, Terry, Stout & Kraus, LLP

(57) ABSTRACT

An anti-mismatching pair of a first and second connectors are constructed such that the first connector (1) is either of a male and female types and has two connective planes each having at least one restricted ridge (11,12). The second connector (21) is correspondingly either of a female and male types and also has two connective planes each having at least one restricting groove (32,33) corresponding to the restricted ridge (11,12). The number and position of the restricted ridge (11,12) as well as those of the restricting groove (32,33) are designed such that the connective planes in each connector (1,21) have overall contours extending symmetrically with each other with respect to the center point (C) of symmetry lying between the connective planes. The one connector (1,21) mates only with the other connector (21,1), whether it is at its obverse position or at its reverse position relative to the other connector, so that a wrong connection of the one connector (1) with any other mismatching connector (22) is avoided.

3 Claims, 6 Drawing Sheets

ANTI-MISMATCHING PAIR OF COMPLEMENTARY CONNECTORS

FIELD OF THE INVENTION

The present invention relates to an anti-mismatching pair of complementary connectors such that one of them is unable to fit in or on any wrong foreign connectors, but able notwithstanding its position obverse or reverse to exclusively engage with the other complementary connector.

PRIOR ART

Generally, the prior art anti-mismatch connectors have each an engagement face formed asymmetric up and down so as not to erroneously engage with wrong connectors, nor to be inverted upside down relative to a correct mating connector. There has been proposed no idea of permitting those anti-mismatch connectors to take their reversed position.

In a case wherein any optional functions are added to a principal existing electronics apparatus, some card-shaped printed circuit boards (hereinafter called 'card-shaped boards') will be incorporated therein. Each of those card-shaped boards has optional electronics circuits and/or devices surface-mounted thereon, together with an anti-mismatch connector. By inserting the board into the apparatus through its supplementary opening, the anti-mismatch connector secured on an edge of the board will fit in or on a mating connector. In this way, an additional electric communication is established between them within said apparatus. Depending on the size and layout of such additional devices on those boards, some of these boards must be inverted when inserting them. Usually, the electronics apparatus has a plurality of such supplementary inlet apertures or openings. Therefore, the card-shaped board has to be inserted through a predetermined one of supplementary openings so as to engage a predetermined one of mating connectors.

SUMMARY OF THE INVENTION

An object of the present invention made considering the requirements and circumstances noted above is to provide an anti-mismatching pair of complementary connectors unlikely to come into wrong connection thereof with any mismatching third connector. This pair of complementary connectors may be designed such that whether one of them takes an obverse position or a reverse position it can engage only with the other complementary connector but can not engage with any other foreign connector.

In order to achieve this object, an anti-mismatching pair of a first and second connectors proposed herein is constructed such that the first connector either of a male or female type comprises two connective planes each having at least one restricted ridge formed integral therewith. The second connector, which correspondingly is either of a female or male type, does likewise comprise two connective planes each having at least one restricting groove formed therein to correspond to the restricted ridge. The number and position of those restricted ridge or ridges and these restricting groove or grooves may be such that the connective planes in each connector have overall contours extending symmetrically with each other with respect to the center point of symmetry lying between them. Such a configuration of each connector will surely restrict it to selectively mate only with another connector of complementary shape, even if it would be reversed upside down.

In an example, one of the first and second connectors may be secured on the end of a card-shaped printed circuit board. Lateral edges of this card-shaped board will be fitted in and guided along a slot that is formed in the other connector so that the one connector can fit in the other connector whether it is at its obverse position or its reverse position relative to the other connector. Preferably, a center plane lying between the connective planes of the connector being fitted in the slot may extend in the direction of insertion to be aligned with the center plane of the card-shaped board.

THE PREFERRED EMBODIMENTS

Figure 1:
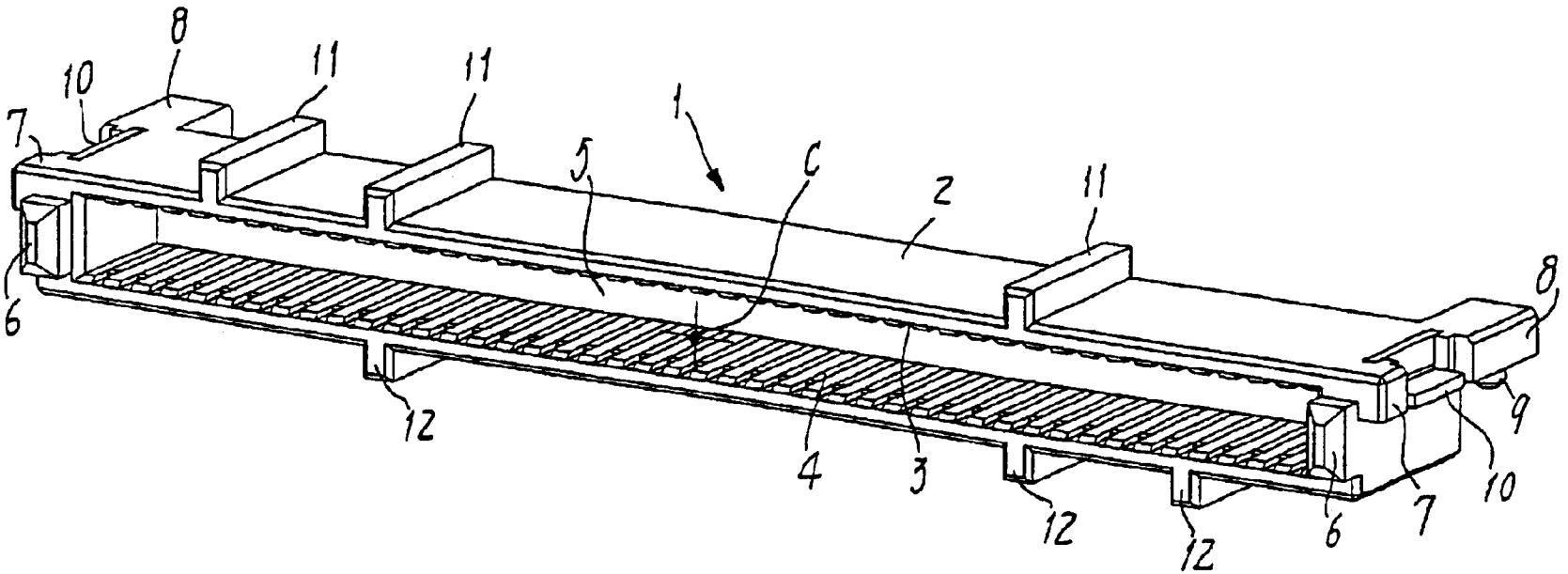
FIG. 1 is a perspective view of an anti-mismatching complementary connector provided herein.

Now some embodiments of the present invention will be described referring to the drawings.

Figure 2:
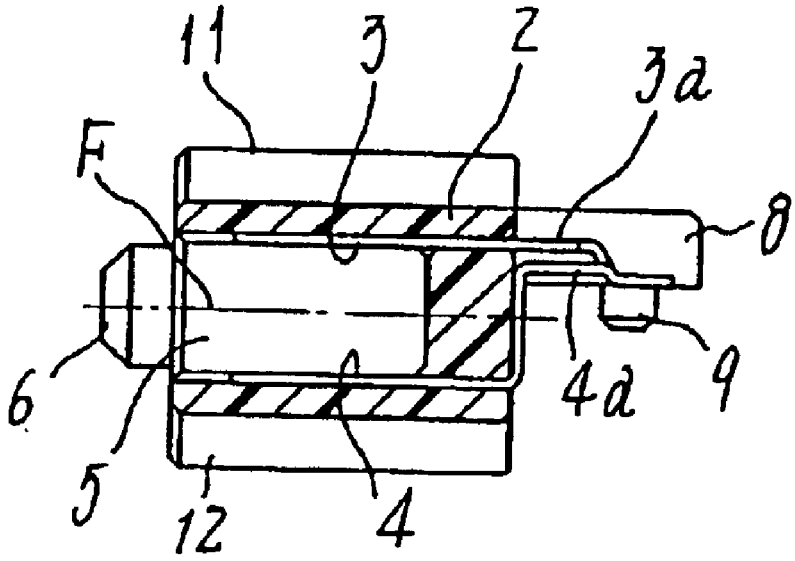
FIG. 2 is a side-elevational cross section of the complementary connector shown in FIG. 1.

FIGS. 1 and 2 show a first complementary connector 1 constituting an anti-mismatching pair of connectors. This connector comprises an insulated housing 2 of a depressed parallelepiped shape extending sideways.

Two rows of socket contacts 3 and 4 are fixed in the insulated housing 2 that has been formed by the insert-molding method.

The housing 2 generally of a box-like shape has a cavity 5 opened forwards between its opposite lateral sides, and comprises a pair of guide lugs 6 disposed at these sides to protrude forwards. The housing 2 further has a pair of first supporting ears 7 protruding sideways from respective fore tops of the lateral sides, in addition to a pair of second supporting ears 8 protruding sideways and backwards from respective rear tops of the lateral sides. Positioning lugs 9 jut down from the respective second supporting ears 8, and a reinforcement tab 10 made of a copper alloy is firmly secured in between each first ear 7 and the corresponding second ear 8. A top connective plane and a bottom connective plane of this housing 2 do respectively have three restricted ridges 11 or 12 serving as the means for prevention of connector mismatching. The ridges 11 extending in the direction of insertion of this connector are spaced from each other in one of the connective planes. The other ridges 12 are similarly formed in the other plane so as to be symmetrical with the one ridges 11 in the one plane, with respect to the center 'C' of the two planes in cross section.

As shown in FIG. 2, the contacts 3 disposed along the ceiling of cavity face the respective other contacts 4 that are disposed along the floor of said cavity. Leads 3*a* and 4*a* of those contacts protrude out from the rear wall of housing are bent at their ends to be included in a common plane. Thus, those contacts 3 and 4 have internal portions held in the cavity 5, which portions are likewise arranged symmetrical with each other with respect to the center 'C' of the two connective planes.

Figure 3:
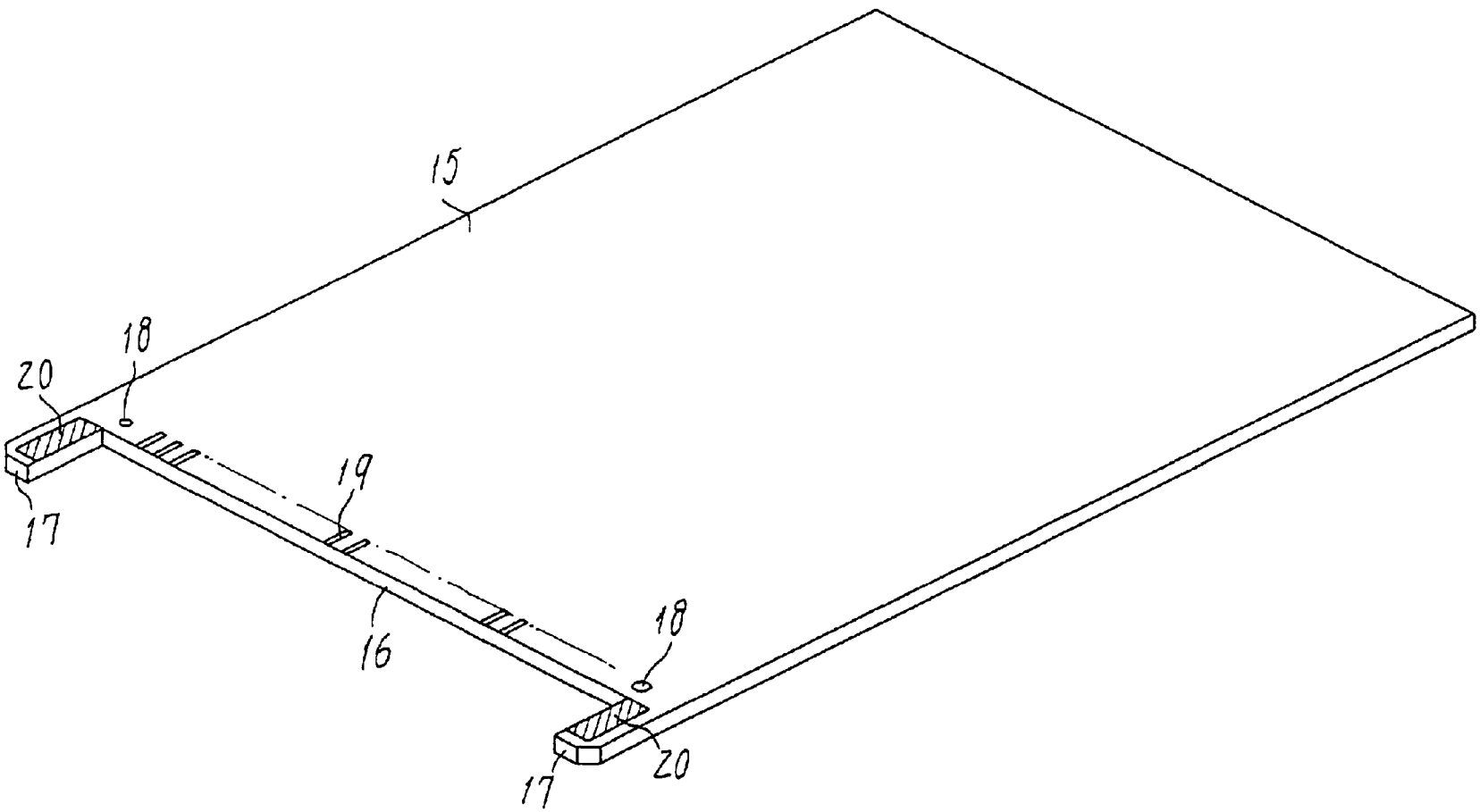
FIG. 3 is a perspective view of a card-shaped printed circuit board on which the complementary connector is to be mounted.

Illustrated in FIG. 3 is a card-shaped printed circuit board (simply called 'card-shaped board' hereinafter) 15 to which the described connector 1 is to be attached. This card-shaped board 15 carries electronic circuits and various devices (not shown) surface-mounted thereon so as to provide an electronic apparatus such as a copying machine with optional functions. Such devices are sometimes disposed not on the upper side but alternatively on the lower side of a card-shaped board 15, if and when necessary in view of the size and layout of them. The card-shaped board 15 has at its fore end a cutout 16 for receiving the connector 1, and fixing arms 17 beside this cutout protrude forwards from fore corners of this board 15. Positioning holes 18 are formed in said board at potions thereof adjacent to the fixing arms 17, in order to engage with the positioning lugs 9 of the connector 1. Parallel solderable stripes 19 arranged at intervals along the inner boundary of said cutout 16 are for the leads 3*a* and 4*a* of contacts 3 and 4. Solderable zones 20 in the respective fixing arms 17 are for the reinforcement tabs 10.

Figure 4:
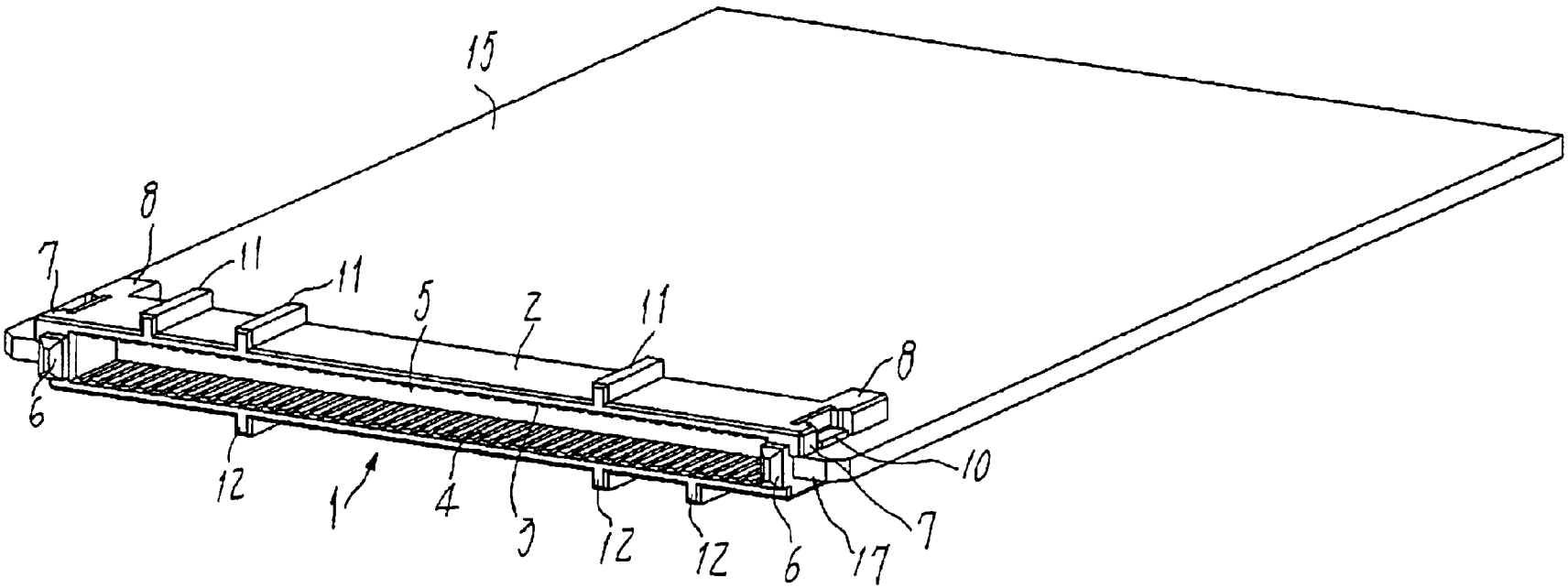
FIG. 4 is a similar perspective view of the card-shaped board on which the connector has been mounted.

Shown in FIG. 4 is the card-shaped board 15 holding in place the connector 1 attached thereto. In this state, the connector 1 is fitted in the cutout 16 that is present at the fore side of board 15. Both the first and second ears 7 and 8 at each lateral end of the connector housing 2 rest on the corresponding fixing arm 17. Each positioning lug 9 fits in the corresponding positioning hole 18 to hold the connector at its correct position relative to the board, before soldering the contacts' leads 3*a* and 4*a* to the stripes 19 and soldering the reinforcement tabs 10 to the zones 20. A lower half of this housing 2 thus surface-mounted on the board 15 bulges down therefrom. An imaginary center plane 'F' extends in the direction of insertion of this connector 1 and includes its center 'C' of opposite connective planes that are for engagement with the mating connector. In other words, the center plane 'F' coincides with the board's medial plane extending perpendicular to its thickness so that the connective planes of the housing 2 will not vary in place relative to the card-shaped board 15, even if this board would be inverted upside down. It will now be apparent that the connective planes of connector 1, inclusive of lateral ends of board 15, for engagement with the mating connector is kept always symmetrical with respect to the center 'C'.

Figure 5:
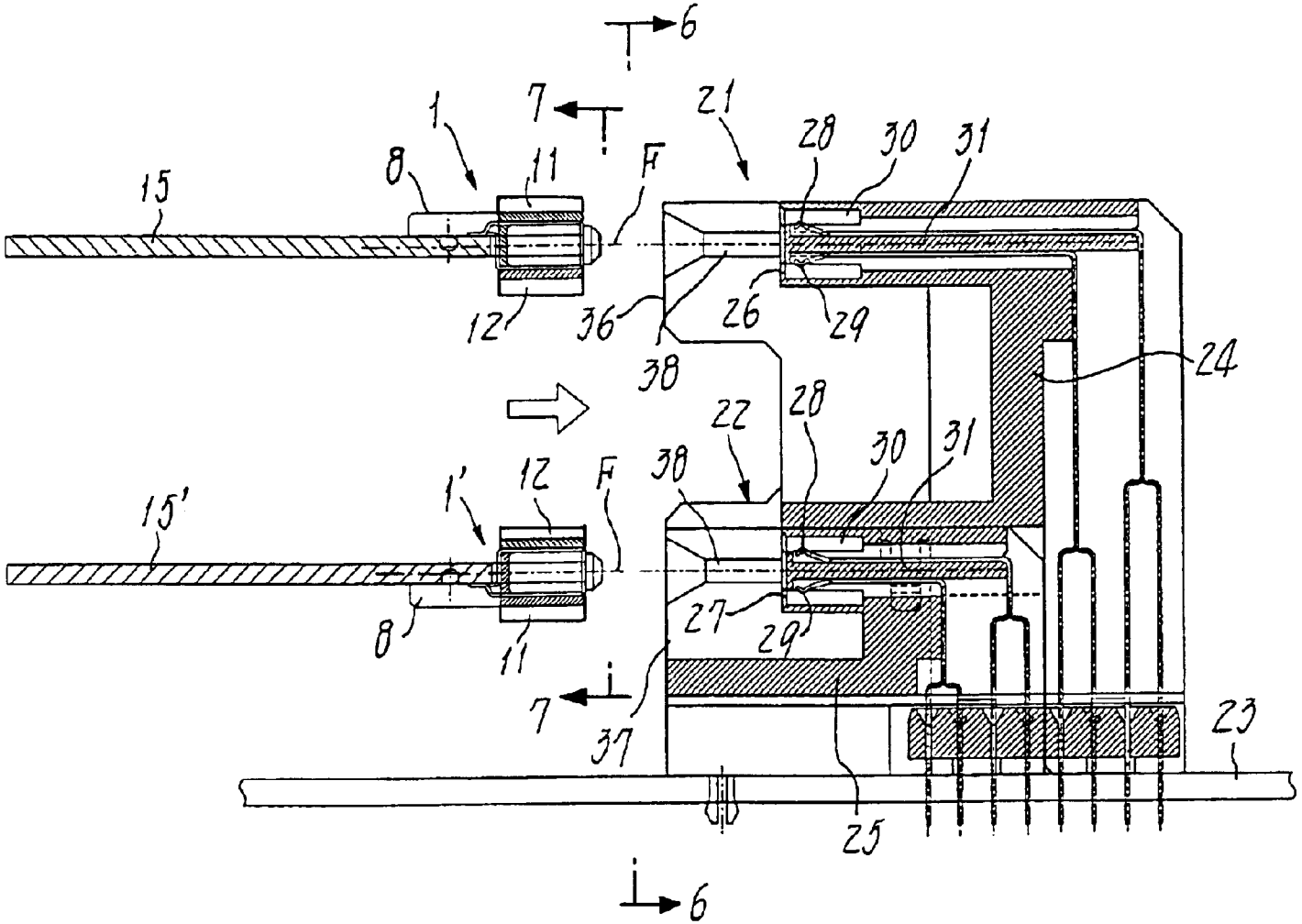
FIG. 5 is a fragmentary vertical cross section of the complementary connector shown together with a corresponding mating connector.
Figure 6:
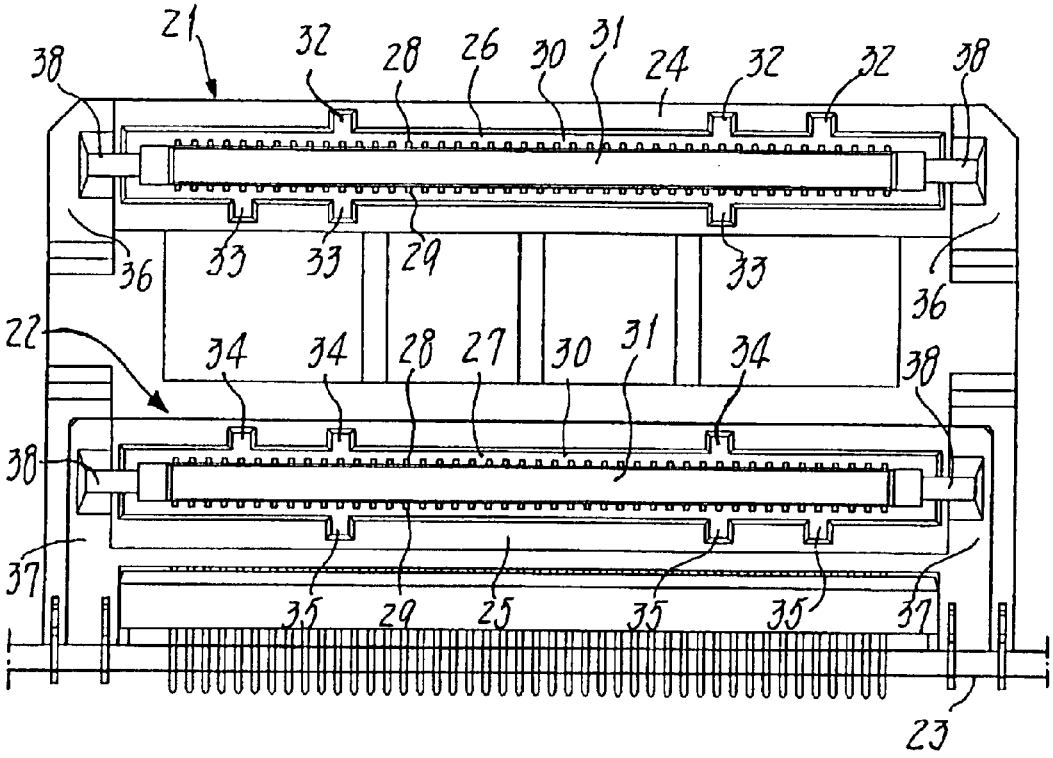
FIG. 6 is a cross section taken along the line 6—6 in FIG. 5.
Figure 7:
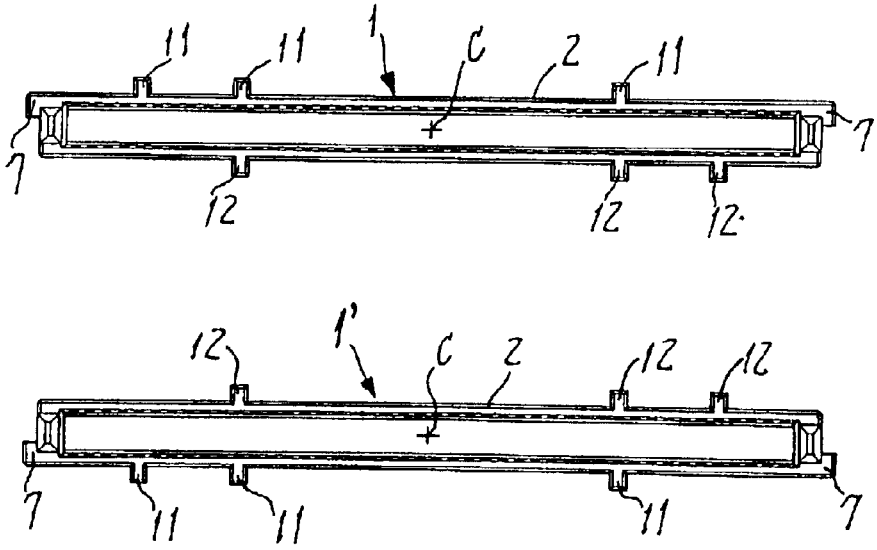
FIG. 7 is a cross section taken along the line 7—7 in FIG. 5.

FIGS. 5 to 7 show an exemplary case wherein the card-shaped printed circuit board 15 having the connector 1 attached thereto will be put in an electronic apparatus through its inlet (not shown). Either of mating connectors 21 and 22 installed in this apparatus will come into an electric engagement with the connector 1.

Those mating connectors 21 and 22 overlying one another are mounted on the surface of a principal printed circuit board 23. Their housings 24 and 25 have respective inlets or slots 26 and 27 as well as rows of plug contacts 28 and 29, all being formed substantially in the same shape and arrangement. Each inlet or slot 26 and 27 has a compartment 30 defined therein for accommodation of the connector housing 2, and a medial partition 31 is fixed in place centrally of and through such a compartment. One of the rows of plug contacts 28 are disposed sideways on the upper face of partition 31, with the other row of contacts 29 being similarly disposed on the lower face of this partition. As will be best seen in FIG. 7, upper restricting grooves 32 formed in the upper wall of the upper inlet 26 are in electric communication with the compartment 30. Lower restricting grooves 33 formed in the lower wall of the upper inlet or slot 26 are also in communication with this compartment 30. Such a set (e.g., a trio) of restricting grooves 32 or 33 corresponding to the restricted ridges 11 or 12 do serve to prevent any wrong coupling of the present connector 1 with a mismatching third connector. It is to be noted here that the compartment 30 has a cross section formed symmetrical with respect to the aforesaid center 'C' of the connective planes of housing 2. On the other hand, upper and lower restricting grooves 34 and 35 formed in the lower inlet or slot 27 are in communication with its compartment 30. However, layout of these latter grooves 34 and 35 differs from that of the former ones 32 and 33 in order to match another connector 1'. This connector 1' is substantially of the same configuration as the first mentioned one 1, except for arrangement of its restricted ridges 11 and 12 (see FIG. 7). Side-walls 36 protrude forwards from lateral ends of the upper inlet 26, and further side-walls 37 likewise protrude from the lower inlet or slot 27. In order to engage and guide the lateral edges of card-shaped board 15 or 15', guide grooves 38 are formed in the respective side-walls 36 and 37.

In operation, fore lateral edge portions of the card-shaped board 15 will be put in the guide grooves 38 of upper mating connector 21 so that the connector 1 carried by this board 15 is ready to introduction into the compartment 30 of upper inlet 26. Then, the housing's restricted ridges 11 and 12 will come into engagement with the respective restricting grooves 32 and 33 within the compartment 30. In this state of the housing 2 fitted in said compartment, the socket contacts 3 come into elastic and electric connection with the plug contacts 28. Simultaneously, the other socket contacts 4 will likewise come into electric connection with the other plug contacts 29. The card-shaped board 15 may be inverted before putting its fore lateral edges into the grooves 38 of upper mating connector 21. The housing 2 of this connector 1 can nevertheless be inserted into the compartment 30 of upper inlet 26 smoothly and neatly, thanks to said housing's opposite connective planes having a center point of symmetry.

Even if any operator would erroneously engage the card-shaped board 15 with the lower guide grooves 38 and try to push it towards the lower mating connector 22, he or she will surely be prevented from bringing this connector 1 into the compartment 30 of lower inlet 27. This is because the restricted ridges 11 and 12 of upper connector 1 thus inverted can not be brought into alignment with the restricting grooves 34 and 35 of lower inlet 27. Thus, the upper printed circuit board 15, whether inverted or not, is capable of being inserted in upper inlet 26 to establish connection between its connector 1 and upper receiving connector 21. However, the operator can never mate the connector 1 with the lower receiving connector 22 by any manner of means.

Similarly, the lower printed circuit board 15', whether inverted or not, is ready to insertion into the lower inlet 27 so as to cause its connector 1' to mate with the lower receiving connector 22. Also in this case, the operator can not match this connector 1' with the upper receiving connector 21 in any way.

In summary, the anti-mismatching pair of complementary connectors provided herein is effective to avoid the problem of erroneously coupling one of them with an undesired third connector, while permitting the one complementary connector to engage with the other whether it is or is not inverted (in other words, whether rotated in vertical direction an angle of 180 degrees or not). In a case wherein the present pair of connectors are employed to electrically connect a card-shaped printed circuit board to a principal existing electronic apparatus, the surface mounting of devices on said board as well as design of board insertion system can be done more freely in a convenient manner. Further, such an anti-mismatching structure can be modified or adjusted just by changing the number and/or layout of those restricted ridges and restricting grooves in any common type of connectors, thus decreasing the number of constituent parts and reducing manufacture cost of them.

What is claimed is:

1. An anti-mismatching pair of first and second connectors, comprising:

first connector of a male type and a female type and comprising two connective planes each having at least one restricted ridge integral therewith; and second connector of another of a female type and a male type and also comprising two connective planes each having at least one restricting groove formed therein to correspond to the restricted ridge;

wherein the number and position of the at least one restricted ridge as well as the number and position of the at least one restricting groove are designed such that the connective planes in each connector have overall contours extending symmetrically with each other with respect to a center point of symmetry lying between the connective planes, so that the first connector mates selectively and only with the second connector, whether it is at its obverse position or at its reverse position relative to the second connector.

2. An anti-mismatching pair of the first and second connectors as defined in claim 1, wherein one of the first and second connectors is secured on an end of a card-shaped printed circuit board, and lateral edges of the card-shaped board are capable of being fitted in and guided along guide grooves formed in the other of the first and second connectors so that the one connector can fit in the other connector whether it is at its obverse position or at its reverse position relative to the other connector.

3. An anti-mismatching pair of the first and second connectors as defined in claim 2, wherein a center plane lying between the connective planes of the one connector being fitted in the guide grooves extends in the direction of insertion of the first one connector so as to be aligned with a center plane of the card-shaped board.

* * * * *